US007637504B1

(12) United States Patent
Gallagher et al.

(10) Patent No.: US 7,637,504 B1
(45) **Date of Patent: *Dec. 29, 2009**

(54) SUITS AND LADDERS GAME

(76) Inventors: L. Scott Gallagher, 133 Ousamequin Pines Rd., E. Bridgewater, MA (US) 02333; Christina L. Gallagher, 133 Ousamequin Pines Rd., E. Bridgewater, MA (US) 02333

( * ) Notice: Subject to any disclaimer, the term of this patent is extended or adjusted under 35 U.S.C. 154(b) by 191 days.

This patent is subject to a terminal disclaimer.

(21) Appl. No.: 11/803,288

(22) Filed: May 14, 2007

Related U.S. Application Data

(63) Continuation-in-part of application No. 11/127,597, filed on May 13, 2005, now Pat. No. 7,216,869.

(51) Int. Cl.
*A63F 1/00* (2006.01)

(52) U.S. Cl. ..... 273/274

(58) Field of Classification Search ..... 273/274, 273/292, 309; 463/12, 13
See application file for complete search history.

(56) References Cited

U.S. PATENT DOCUMENTS 5,593,161 A * 1/1997 Boylan et al. ..... 273/274
5,636,843 A * 6/1997 Roberts ..... 273/292
5,718,431 A * 2/1998 Ornstein ..... 273/292
6,189,888 B1 * 2/2001 Brunelle ..... 273/292
6,439,573 B1 * 8/2002 Sklar ..... 273/292
6,550,772 B1 * 4/2003 Streeks et al. ..... 273/292
6,575,467 B1 * 6/2003 Kal ..... 273/292
6,585,588 B2 * 7/2003 Hartl ..... 463/16
6,648,754 B2 * 11/2003 Baerlocher et al. ..... 463/17
6,679,492 B2 * 1/2004 Markowiak ..... 273/138.1
7,048,274 B2 * 5/2006 Duncombe et al. ..... 273/274
7,137,629 B2 * 11/2006 Chapman ..... 273/292
7,222,855 B2 * 5/2007 Sorge ..... 273/292
2006/0066050 A1 * 3/2006 Sorge ..... 273/292
2008/0106037 A1 * 5/2008 Smith et al. ..... 273/274

* cited by examiner

*Primary Examiner*—William M Pierce
(74) *Attorney, Agent, or Firm*—John P. McGonagle

(57) ABSTRACT

A wagering game between a dealer and one or more players involving one or more decks of cards, a plurality of betting boards and player markers. Each betting board has four betting places corresponding to one of four card suits and two betting places corresponding to one of two card colors. A ladder presenting progressively increasing designated odds payoff is represented above the betting places. Each player makes a bet by selecting a betting place with a marker. A dealer deals one card. If the betting place matches the suit or color of the card dealt, the player is a winner. The winner may accept the designated odds payoff or may continue play during the next iteration at a higher designated odds payoff. If the player's betting place does not match the suit or color of the card dealt, the player loses and the dealer is the winner.

2 Claims, 2 Drawing Sheets

SUITS AND LADDERS GAME

CROSS-REFERENCE TO RELATED APPLICATIONS

This is a Continuation-In-Part of U.S. patent application Ser. No. 11/127,597, filed May 13, 2005, now U.S. Pat. No. 7,216,869, Issued May 15, 2007.

BACKGROUND OF THE INVENTION

This invention relates to wagering games involving a dealer, one or more players, and one or more decks of cards having a plurality of suits.

Many card games have been developed and some are particularly adapted for gambling. One class of such games includes a dealer who deals cards and a plurality of players who place wagers based on the cards that the dealer deals. Various progressive jackpot wagering games have also been developed. Other games also disclose the concept of adding additional wagers when cards are dealt.

There is a demand for new card games, particularly by casinos, which are, at the same time, innovative and interesting, but simple enough for players to easily learn. It has been found that many potential players are discouraged from playing because they do not understand the complexity of the game and are self-conscious about showing their lack of expertise.

Accordingly, it is an object of the present invention to provide an improved wagering game, which is innovative and interesting.

It is also an object of the invention to provide an improved wagering game for casinos which is simple enough for most persons to understand without complicated instructions.

SUMMARY OF THE INVENTION

In accordance with these objects, there is provided, according to one aspect of the invention, a wagering game between a dealer and one or more players involving one or more decks of cards, a plurality of betting boards and player markers. Each betting board has four betting places, each place corresponding to one of four card suits, said betting places being arranged near the bottom of the betting board. The betting board also has provision for betting on the color of the card. A ladder presenting progressively increasing designated odds payoff is represented above the betting places. Each player makes a bet by selecting a betting place with a marker. A dealer deals one card. If the betting place matches the suit or color of the card dealt, the player is a winner. The winner may accept the designated odds payoff or may continue play during the next iteration at a higher designated odds payoff. If the player's betting place does not match the suit or color of the card dealt, the player loses and the dealer is the winner. Players may make side bets on the value of the card dealt as agreed to between player and dealer.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
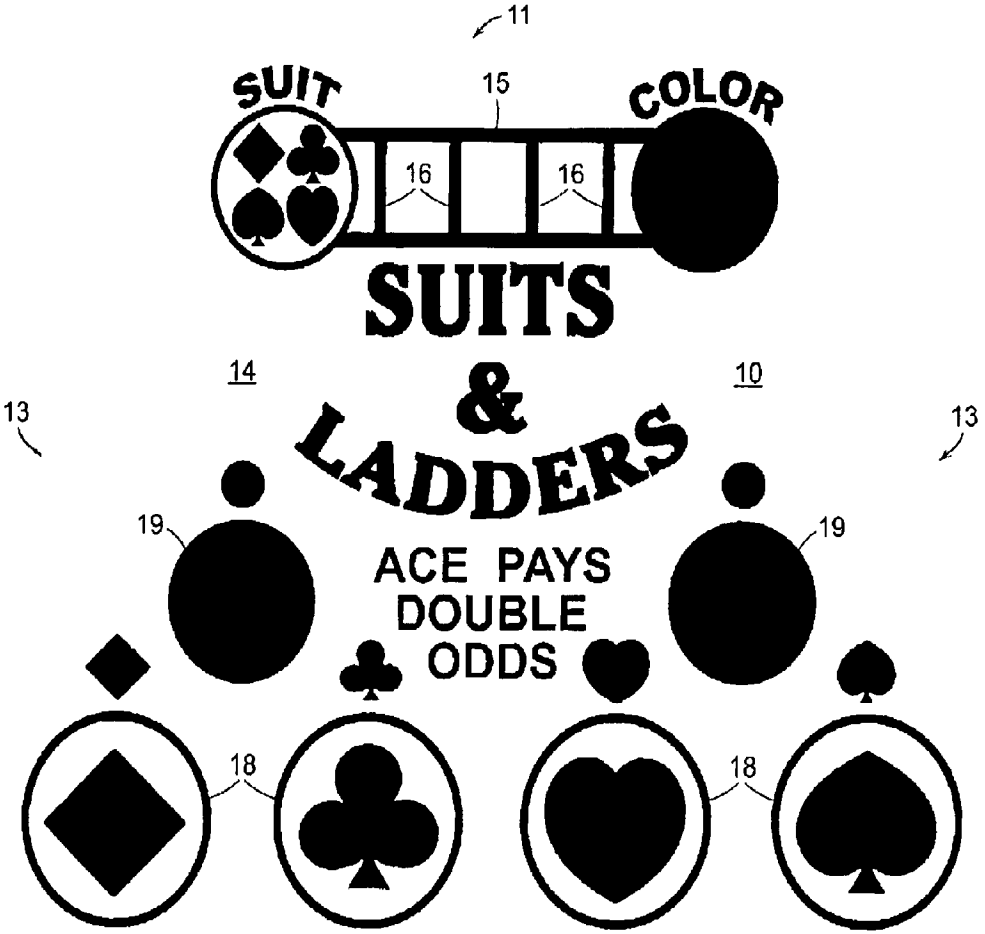
FIG. 1 is a top plan view of a betting board used in the invention.

Referring to the drawings in detail wherein like elements are indicated by like numerals, there is shown in FIG. 1 a generally rectangular, flat, player's betting board 10 having a top 11, bottom 12, two opposite side edges 13 and a playing surface 14. The playing surface 14 has a plurality of suit betting spaces 18 arranged into a horizontal row near the bottom 12 of the betting board 10, said betting spaces 18 representing the four suits of a standard deck of playing cards. Just above the suit betting spaces 18 are two betting spaces 19 representing the two colors of a standard deck of playing cards. The betting board 10 has a representation of a ladder 15 near to the betting board top 11. The ladder 15 has a plurality of rungs 16 representing progressively increasing designated odds payoff, with the rung farthest to the left being set at the lowest odds. The odds progress as the rungs move to the right, with the rung 16 closest to the right having the greatest odds. In this embodiment of the invention, the row odds progress as follows for suits: 2:1, 4:1, 5:1, 7:1, and 20:1. For color, the odds are: 0:1, 1:1, 1:1, 3:1, and 5:1. Other embodiments may have different odds.

Figure 2:
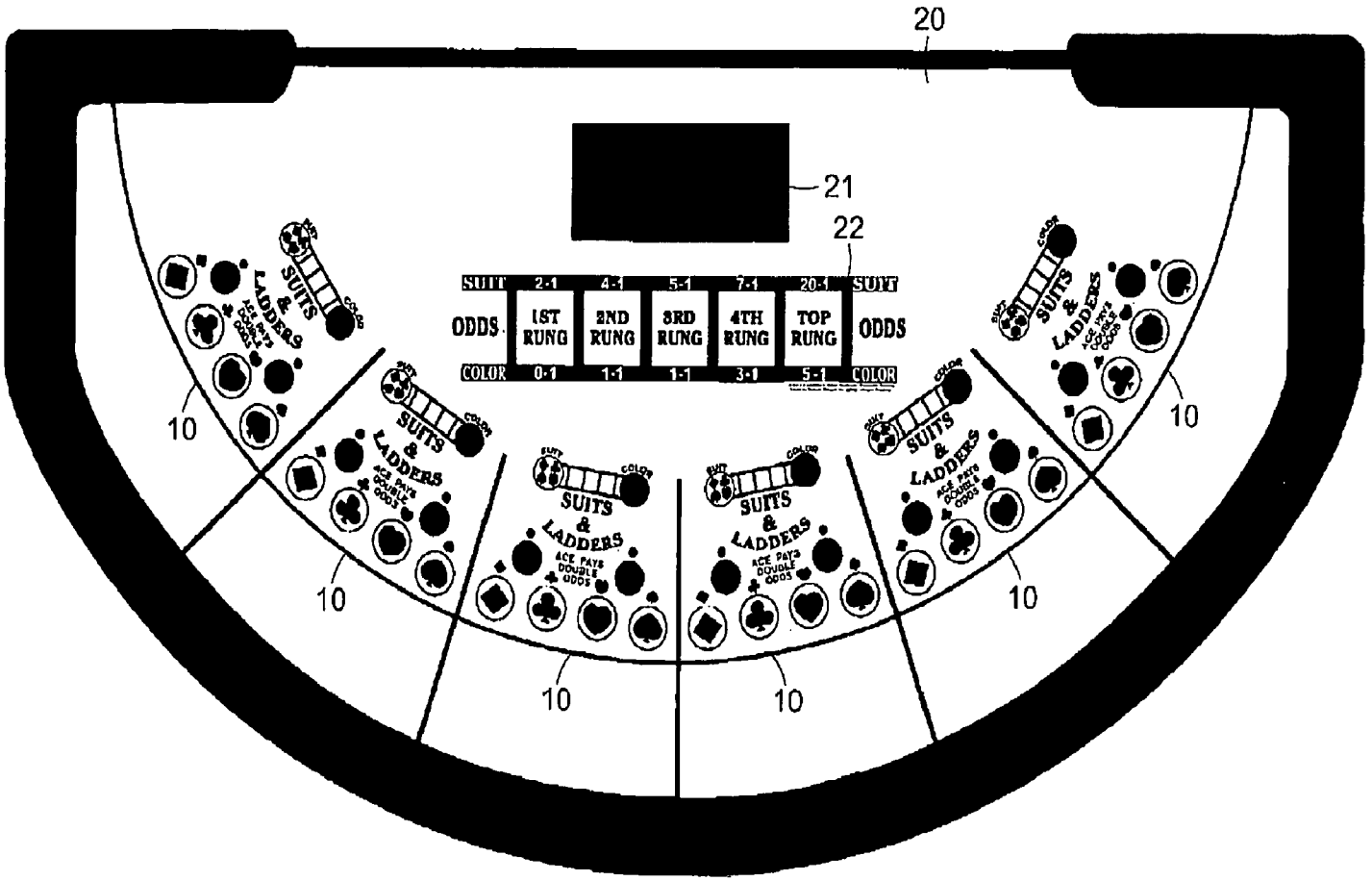
FIG. 2 is a top plan view of a table layout with multiple betting boards for multiple players.

FIG. 2 illustrates a typical betting board table layout 20 for the game, including a chip rack area 21 and a dealer ladder area 22. There is also a plurality of betting areas, each area having a betting board 10 imprinted thereon.

A player places a wager (bet) on any one, two, three or four of the four suit positions 18 on the bottom of the individual player's betting board 10. He may also bet on the color of the card to be dealt by placing a wager on one of the betting sports 19 above the suit positions 18. The dealer then flips a single card for play in the first rung area of the odds designated ladder 22 on the table 20. The dealer then collects any unsuccessfully selected (mismatched) wagers.

If the player or players's wager has successfully selected (matched) the color or suit on the dealt card, the dealer then moves the wager up into the ladder climb area paying the appropriate color or suit odds designated for that rung. The player or player's wager is now on the ladder and ready to climb the rungs 16 of the ladder 15 at increasing odds. The quest of each player is to match the dealt cards and reach the top rung. The game is now closed to any player that has failed to match either a color or suit with their designated wager.

The dealer then instructs any player or players with a wager in the ladder climb area to now select any one of the four suit positions 18 and/or two color positions 19. The dealer then flips a single card for play on the next rung 16 of the odds designated ladder 15.

If the player has successfully selected (matched) the suit or color, the dealer then pays the player the appropriate suit or color odds designated for that rung. If a player has not selected the dealt suit or color, the dealer collects the player's wager and the player must begin again at the bottom of the ladder when the game reopens.

The game opens again for the entire table when there are no more bets left in the ladder climb. Game play continues until the player or players reach the top rung of the ladder matching any dealt suits or colors successfully or fail to match either a suit or color on any ladder rung.

In this embodiment of the invention, an ace pays double. If the dealer flips an ace, and a player has correctly selected the proper suit or color, the dealer then pays the player double the appropriate odds designated for that play.

It is understood that the above-described embodiment is merely illustrative of the application. The house or casino may have the option for a single deck deal or multiple deck deal. Other embodiments may be readily devised by those skilled in the art which will embody the principles of the invention and fall within the spirit and scope thereof.

We claim:

1. A method of playing a wagering card game between a dealer and a plurality of players using a plurality of fifty-two card decks having four suits and two colors, comprising the sequential steps of:

providing a betting board table surface, including a chip rack area, a dealer ladder area having a plurality of odds positions, and a plurality of betting areas, each betting area having a betting board imprinted thereon, each said betting board having a top, a bottom, two opposite sides and a playing surface, said playing surface having a plurality of suit betting spaces arranged into a horizontal row near to said betting board bottom, said betting spaces representing said four suits, and a two of color betting spaces arranged above said suit betting spaces, said betting board having a ladder above said betting spaces extending horizontally from left to right, said ladder having a plurality of rungs representing progressively increasing designated odds payoffs, wherein the rung closest to the betting board left side is set at the lowest odds, and the rung furthest to the betting board right side is set at the greatest odds, said dealer ladder odds positions corresponding to the ladder rungs on the betting boards;

each player being assigned to a betting area;

each player placing a marker on a one of the four suit betting spaces on the bottom row in the player's assigned betting area;

each player placing a marker on a one of the color betting spaces above the suit betting spaces in the player's assigned betting area;

each player placing a wager amount on the ladder in the player's assigned betting area;

the dealer placing a marker on an odds position with a lowest odds payoff;

the dealer flipping a single card for play showing one of four said suits and one of two colors;

the dealer paying an amount designated by said odds position with a dealer marker to each player with a designated betting area who has placed a marker on a betting space matching the suit of the card flipped for play;

the dealer paying an amount designated by said odds position with a dealer marker to each player with a designated betting area who has placed a marker on a betting space matching the color of the card flipped for play;

the dealer collecting the wagers of all players failing to match the suit or color of the card flipped for play;

each player having successfully selected the suit or color on the flipped card, at his option, keeping his winning wager up on the ladder in his assigned betting area and placing a marker on one or more of the suit and color betting spaces on the bottom row in the player's assigned betting area;

the dealer placing a marker on an odds position with the next highest odds payout;

the dealer flipping a single card for play showing one of four said suits and two colors;

the dealer paying an amount designated by said odds position with a dealer marker to each player with a designated betting area who has placed a marker on a betting space matching the suit and color of the card flipped for play;

the dealer collecting the wagers of all players failing to match the suit of the card flipped for play;

repeating the above steps until the dealer completes the game at the odds position with the highest odds payout, or all remaining players fail to match a suit or color on any row; and the dealer collecting each wager of a player who unsuccessfully selects a dealt suit or color.

2. A method of playing a wagering game as recited in claim 1, further comprising:

the dealer paying a player double the payoff odds if an ace is flipped by the dealer and the player has correctly selected the proper suit or color.

* * * * *